United States Patent [19]

Uesugi

[11] Patent Number: 4,860,212

[45] Date of Patent: Aug. 22, 1989

[54] ROLLED STRIP SHAPE DETECTING DEVICE WITH HIGH ACCURACY

[75] Inventor: Kenichi Uesugi, Kobe, Japan

[73] Assignee: Kabushiki Kaisha Kobe Seiko Sho, Kobe, Japan

[21] Appl. No.: 104,973

[22] Filed: Oct. 6, 1987

[30] Foreign Application Priority Data

Oct. 8, 1986 [JP] Japan ..... 61-238045
Apr. 28, 1987 [JP] Japan ..... 62-103197

[51] Int. Cl.[4] ..... G06F 15/46; B21B 37/04

[52] U.S. Cl. ..... 364/472; 72/12; 72/17

[58] Field of Search ..... 364/472, 469; 72/17, 72/8–12

[56] References Cited

U.S. PATENT DOCUMENTS 4,269,051 5/1981 Clarke et al. ..... 364/472 X
4,289,005 9/1981 Cabaret et al. ..... 72/17 X
4,512,170 4/1985 Hsu ..... 72/17
4,587,819 5/1986 Hausen ..... 72/17 X
4,612,788 9/1986 Kitagawa ..... 72/17
4,633,693 1/1987 Tahara et al. ..... 72/17
4,674,310 6/1987 Ginzburg ..... 72/17

FOREIGN PATENT DOCUMENTS 77693 7/1981 Australia .

*Primary Examiner*—Joseph Ruggiero
*Attorney, Agent, or Firm*—Oblon, Spivak, McClelland, Maier & Neustadt

[57] ABSTRACT

A rolled strip shape detecting device includes a tension detecting device for detecting tension applied to a shape detecting roller, a storage device for storing information relating to the rolled strip and the roller, and an arithmetic device for computing deflection of the roller according to the tension detected by the tension detecting device and the information stored by the storage device and correcting a rolled strip shape detected by the roller according to the deflection of the roller as computed above. Alternatively, a roller deformation detecting device is provided to detect deformation of the roller due to tension applied thereto and the arithmetic device computes the deflection of the roller according to the deformation detected by the roller deformation detecting device and the information stored in the storage device.

12 Claims, 6 Drawing Sheets

ROLLED STRIP SHAPE DETECTING DEVICE WITH HIGH ACCURACY

BACKGROUND OF THE INVENTION

1. Field of the Invention

The present invention relates to a rolled strip shape detecting device, and more particularly to a device for detecting a shape of a rolled strip with a higher accuracy by compensating a shape detection error of an actual strip as generated because of deflection of a roller caused by tension of the rolled strip and tare of the roller.

2. Description of the Prior Art

Generally, in producing a rolled strip such as a steel strip or a nonferrous metal strip such as an aluminum plate or foil, it is necessary to detect a shape across the width of the rolled strip rolled by a rolling mill. It is known that means for detecting the shape of the rolled strip across its width is provided downstream of the rolling mill.

FIG. 7 shows a schematic illustration of a conventional shape detecting device for the rolled strip. A shape detecting roller 3 is provided between an outlet of the rolling mill 1 and a strip winding reel (winder) 2 in such a manner as to contact a rolled strip 4. A detection signal of strip shape as detected by the shape detecting roller 3 is fed to a signal processing computer 5. After being processed by the computer 5, the strip shape is indicated by a shape display panel 6 connected to the computer 5.

In particular, as shown in FIG. 8, the shape detecting roller 3 is of a division type such that a plurality of discs 7 are axially stacked to be united as an integral roller.

Each disc 7 is provided with a sensor 8 for detecting a radial load applied to the outer peripheral surface of the disc contacting the roller strip. A distribution box 9 is provided at one end of the shape detecting roller 3, and a rotation transmitter 10 is interposed between the shape detecting roller 3 and the distribution box 9. Detection signals from each sensor 8 are transmitted through the rotation transmitter 10 and the distribution box 9 to the computer 5.

Thus, the load applied across the width of the rolled strip 4 is measured by each sensor 8 in the discs 7 of the shape detecting roller 3. Then, the strip shape across the width of the rolled strip 4 is calculated by the computer 5 according to the detection signals from the sensors 8, and is indicated by the shape display panel 6.

Further, although not shown, the shape signal of the rolled strip 4 is also outputted from the computer 5 to any control system for the rolling mill 1.

However, generally in the shape detecting roller for the rolled strip, the axis of the shape detecting roller 3 formed by the plural discs 7 is deflected by the tension of the rolled strip 4 and the tare of the shape detecting roller 3 as shown in FIG. 9.

Because of such deflection, a distance $L_i$ from an output end A of the rolling mill 1 through the outer periphery of the shape detecting roller 3 to a take-up point B of the winding reel 2 at various transverse points of the rolled strip 4 ($L_i$ corresponds to the disc 7 placed at the number of i counted from a transverse end of the strip) is rendered smaller than a distance L similarly measured at a bearing portion of the shape detecting roller 3. In the conventional device, such error in the distance is not accounted for, and the strip shape is therefore computed in such a manner as if the central portion across the width of the rolled strip were extended.

For example, letting the minimum distance at the transverse central portion of the rolled strip 4 denote $L_{min}$ and the maximum distance at both the transverse ends of the rolled strip 4 denote $L_{max}$, there is generated a maximum detection error $\epsilon=[(L_{max}-L_{min})/L_{max}]\times 10^5$ [*I*—*Unit*] *in the conventional shape detecting device which takes no account of the deflection of the shape detecting roller. That is, the value of an actual shape* $+\epsilon$[*I*—*Unit*] *is detected at the central portion of the rolled strip 4.*

While the shape detection error of the rolled strip 4 due to the deflection of the axis of the shape detecting roller 3 in a low-tension shape detecting device (under a tension value of about 1–2 ton, for example) occupies a relatively small proportion of the whole error, the shape detection error due to the deflection in a high-tension shape detecting device for a high-tension thin sheet rolling mill, for example, occupies a considerable proportion (about 20–50%) of the whole error. In this manner, the error due to the deflection of the shape detecting roller 3 generated by the tension of the rolled strip 4 and the tare of the roller 3 is included as it stands into the detection output from the shape detecting device, causing a reduction in detection accuracy.

SUMMARY OF THE INVENTION

It is an object of the present invention to overcome the problem as mentioned above and provide a device for detecting a rolled strip shape with a high accuracy by considering the deflection due to the tension of the rolled strip and the tare of the roller and correcting a value of the strip shape according to the deflection.

It is another object of the present invention to provide a shape detecting device which may feed a proper data to any control system in producing a rolled strip and thereby improve the flatness of the rolled strip.

According to a first aspect of the present invention, there is provided a rolled strip shape detecting device of high accuracy comprising a tension detecting means for detecting tension applied to a shape detecting roller, a storage means for storing information relating to the rolled strip and the roller, and an arithmetic means for computing deflection of the roller according to the tension detected by the tension detecting means and the information relating to the rolled strip and the roller stored by the storage means, and correcting a rolled strip shape detected by the roller according to the deflection of the roller as computed above.

According to a second aspect of the present invention, there is provided a rolled strip shape detecting device of high accuracy comprising a roller deformation detecting means for detecting deformation of a shape detecting roller due to tension applied to the roller, storage means for storing information relating to the rolled strip and the roller, and arithmetic means for computing deflection of the roller according to the deformation detected by the roller deformation detecting means and the information relating to the rolled strip and the roller stored by the storage means, and correcting the rolled strip shape detected by the roller according to the deflection of the roller as computed above.

In the rolled strip shape detecting device according to the first aspect of the present invention, the tension applied to the shape detecting roller is detected by the tension detecting means, and the deflection of the roller is computed by the arithmetic means according to the tension as detected above and the information relating to the rolled strip and the roller as stored in the storage means. Then, an error in the value of the strip shape detected by the roller is corrected according to the deflection as computed above.

Furthermore, in the rolled strip shape detecting device according to the second aspect of the present invention, the deformation of the shape detecting roller due to the tension applied to the roller is detected by the roller deformation detecting means, and the deflection of the roller is computed by the arithmetic means according to the deformation as detected above and the information relating to the rolled strip and the roller as stored in the storage means. Then, an error in the value of the strip shape detected by the roller is corrected according to the deflection as computed above.

Other objects and features of the invention will be more fully understood from the following detailed description and appended claims when taken with the accompanying drawings.

DESCRIPTION OF THE PREFERRED EMBODIMENTS

Figure 1:
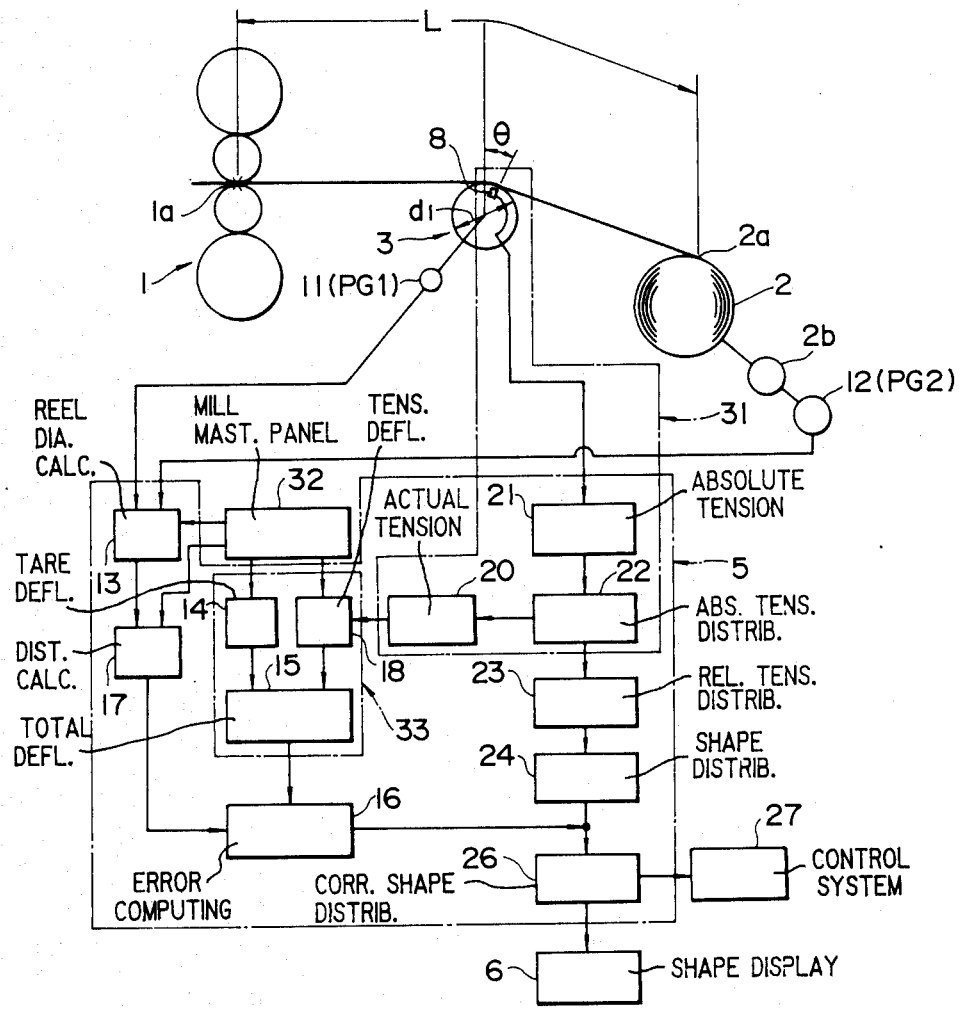
FIG. 1 is a block diagram of a first preferred embodiment of the present invention.

Referring now to FIG. 1, as substantially similar to the conventional shape detecting device, a shape detecting roller 3 is provided between an outlet of a rolling mill 1 and a strip winding reel (winder) 2 in such a manner as to contact a rolled strip 4. A detection signal of strip shape as detected by the shape detecting roller 3 is fed to a signal processing computer 5. After being processed by the computer 5, the strip shape is indicated by a shape display panel 6 connected to the computer 5.

The process of calculation of the shape of the rolled strip 4 by the computer 5 includes an absolute tension calculating step 21 for calculating the absolute tension of the rolled strip per element according to a signal of radial load Tr detected by the sensor 8 in each disc 7 of the shape detecting roller 3, an absolute tension distribution calculating step 22 for calculating an absolute tension distribution in the axial direction of the roller 3 (across the width of the rolled strip 4) from the absolute tension per element, a relative tension distribution calculating step 23 for calculating a relative tension distribution of the rolled strip 4 on the basis of the tension at both ends of the rolled strip 4, and a shape distribution calculating step 24 for calculating the strip shape signal across the width of the rolled strip 4 according to the relative tension distribution calculating step 23.

In addition to the above strip shape detecting device, there is provided a deflection detecting algorithm for detecting the deflection of the strip shape detecting roller. The deflection detecting algorithm comprises a tension calculating system 31 as the tension detecting means provided in the computer 5, a mill master panel 32 as the storage means for storing the information relating to the rolled strip 4 and the roller 3, and an arithmetic means 33 for computing deflection of the shape detecting roller 3 according to the tension detected by the tension calculating system 31 and the information from the mill master panel 32.

The tension calculating system 31 includes a part of the detecting and computing system for the calculation of the shape of the rolled strip 4, namely, the sensor 8 of the shape detecting roller 3, the absolute tension calculating step 21 and the absolute tension distribution calculating step 22. The system 31 further includes an actual tension calculating section 20 for calculating the actual tension of the rolled strip 4 according to the absolute tension distribution calculated in the absolute tension distribution calculating step 22.

Figure 2:
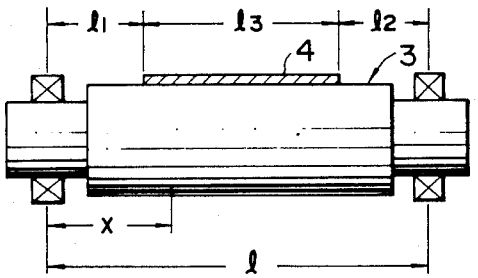
FIG. 2 is a sectional view of the shape detecting roller.

The mill master panel 32 stores a span l of the shape detecting roller 3 (a distance between centers of the bearings for the roller), a width $l_3$ of the rolled strip 4, distances $l_1$ and $l_2$ between each center of the bearings for the roller 3 and each transverse end of the rolled strip 4 near the bearings (see FIG. 2 with respect to each distance $l_1$, $l_2$, $l_3$ and l), a geometrical moment of inertia I of the shape detecting roller 3, an elastic constant E of the shape detecting roller 3, a weight $W_2$ of the shape detecting roller 3 per unit length between the centers of the bearings for the roller 3, a diameter d of the shape detecting roller 3, and a contact angle $\theta$ of the rolled strip 4 to the shape detecting roller 3. A length $L_{max}$ of the rolled strip 4 passing from a pressure point 1a of the rolling mill 1 to a take-up point 2a of the winding reel 2 is calculated as time proceeds since the length changes with a diameter of the reel of the rolled strip.

The arithmetic means 33 comprises a tension deflection computing section 18 for computing the deflection of each disc 7 of the shape detecting roller 3 due to the tension of the rolled strip 4 according to the actual tension from the actual tension calculating section 20 in the tension detecting system 31 and various information (i.e. each value of $l_1$, $l_2$, $l_3$, l, I, E and $\theta$) from the mill master panel 32, a tare deflection computing section 14 for computing the deflection of each disc 7 of the shape detecting roller 3 due to the tare of the roller 3 according to various information (each value of $W_2$, l, E and T) from the mill master panel 32, and a total deflection calculating section 15 for calculating the total deflection (the sum of the deflection due to the tension and the deflection due to the tare) of each disc 7 of the shape detecting roller 3 from the results of computation by the tension deflection computing section 18 and the tare deflection computing section 14.

There is further provided an error computing section 16 for calculating an error (shape correction value) according to the total deflection of each disc 7 from the total deflection calculating section 15 in the arithmetic means 33 and the information from the mill master panel 32. The error calculated by the error computing means 16 is fed to a corrected shape distribution calculating section 26.

The calculation of error in the error computing section 16 is conducted in accordance with the following expression.

$$\epsilon_i=[(L_{max}-L_i)/L_{max}]\times 10^5\ (I-Unit)$$

where, $\epsilon_i$ denoted an error in the disc 7 placed at the number of i; $L_{max}$ denotes a maximum value of L (the length of the rolled strip 4 passing from the pressure point 1a of the rolling mill 1 to the take-up point 2a of the winding reel 2); and $L_i$ denotes a value of L at the disc 7 placed at the number i.

For the purpose of calculating the values of $L_{max}$ and $L_i$, there are provided a pulse generator (PG 1) 11 for detecting a rotative speed of the shape detecting roller 3, a pulse generator (PG 2) 12 for detecting a rotative speed of the winding reel 2, and a reel diameter calculating section 13 for calculating a reel diameter D of the winding reel 2 according to detection signals of the rotative speeds from both the pulse generators 11 and 12 and the information (the value of d) from the mill master panel 32. Then, the value of L is calculated by a distance calculating section 17 according to the value D from the reel diameter calculating section 13 and each shape value from the mill master panel 32.

Further, the corrected strip shape across the width of the rolled strip 4 is indicated by the shape display panel 6 according to a signal from the corrected shape distribution calculating section 26. The signal from the corrected shape distribution calculating section 26 is also fed to the control system 27 for the rolling mill 1 as well as the shape display panel 6. Reference numeral 2b shown in FIG. 1 designates a driving motor for the winding reel 2.

Thus, the rolled strip shape detecting device of the first preferred embodiment is constructed as mentioned above. The actual tension of the rolled strip 4 is calculated by the actual tension calculating section 20, and a deflection $V_1$ of the shape detecting roller 3 due to the tension of the rolled strip is calculated according to the actual tension and each value of $l_1$, $l_2$, $l_3$, l and $W_2$ in accordance with an expression of beam deflection.

Considering the shape detecting roller 3 as a beam on which a load of the rolled strip 4 is mounted (see FIG. 2), and provided that the rolled strip 4 having a distributed load $W_1$ is mounted on a part of the beam simply supported at both ends, the deflection $V_1$ per disc 7 is calculated in accordance with the following expressions. The distributed load $W_1$ is expressed by $W_1=Tr/l_3$, where Tr is a radial load received by the shape detecting roller 3.

Assuming that a transverse position of a certain disc 7 across the width of the rolled strip 4 (a distance from the center of the bearing at one end of the roller 3 to the disc 7) is denoted by x, the deflection $V_1$ is given by the following expressions.

(1) When the distance x ranges $0\leqq x\leqq l_1$, the deflection $V_1$ is $$V_1 = W_1\cdot[2\{l_2^2-(l-l_1)^2\}\cdot x^2/l + \{(l-l_1)^2\cdot(l^2+2l_1\cdot l-l_1^2) - l_2^2\cdot(2l^2-l_2^2)\}]/(24E\cdot I) \quad (1)$$

(2) When the distance x ranges $l_1\leqq x\leqq(l_1+l_3)$, the deflection $V_1$ is $$V_1 = W_1\cdot[l_3\cdot x\cdot(l_2+l_3/2)\cdot\{(l_1+l_3/2)\cdot(l+l_2+l_3/2)-l_3^2/4-x^2\}+(x-l_1)^4/4]/(6E\cdot I) \quad (2)$$

Let $l_1$, $l_2$, $l_3$ and l give $l_1=l_2=190$ mm, $l_3=1300$ mm and $l=1680$ mm, for example. The maximum deflection of the beam is the deflection ($V_m$) at a central position (x=840 mm) of the roller, and this maximum deflection $V_m$ is calculated in the following manner. The radial load Tr is calculated as follows:

$$Tr=2\times T_{max}\times\sin(\theta/2)=7830\ (kgf)$$

where, $T_{max}$ is the actual tension calculated by the actual tension calculating section 20; and $\theta$ is a contact angle. In this example, $T_{max}=30.000$ (kgf) and $\theta=15°$are given. Accordingly, $V_m=0.446$ mm is given. Further, a deflection ($V_a$) of the shape detecting roller 3 at the end portion of the rolled strip 4 is calculated to obtain $V_a=0.156$ mm.

On the other hand, considering a beam having a span l and simply supported at both ends on which beam a distributed load $W_2$ is mounted, a deflection $V_2$ of the shape detecting roller 3 due to the tare thereof is calculated in the following manner. A maximum deflection is a deflection ($V_n$) at the central position of the roller. The deflection $V_n$ is given by the following expression.

$$V_n=5W_2.l^4/(384E.I)$$

Where $W_2$ and l have the value of $W_2=0.356$ kgf/mm and $l=1680$ mm in the above expression, then, $V_n=0.028$ mm.

A deflection ($V_b$) due to the tare of the roller at a position corresponding to the end portion of the rolled strip is calculated by the following expression.

$$V_b=W_2.l^3.x.(1-2x^2/l^2+x^3/l^3)/(24\ E.I)$$

where, x is expressed as x=190. Substituting the same values as above for $W_2$ and l, $V_b=0.010$ mm.

Consequently, a maximum deflection is obtained by subtracting the deflection at the position corresponding to the end portion of the rolled strip 4 from the deflection at the central position of the shape detecting roller 3. Thus, the maximum deflection is expressed as $(V_m-V_a)+(V_n-V_b)=0.308$ mm.

Depending on such a difference in deflection, the error computing section 16 calculates an error, that is, a change in the length L of the path of the rolled strip 4 from the pressure point 1a of the rolling mill 1 to the take-up point 2a of the winding reel 2 in the following manner.

Assuming that L is 6228.832 mm at a certain position of the roller 3 under no deflection, the value of L is changed to 6228.750 mm when the roller 3 at this position is deflected by 0.308 mm.

Accordingly, the error d is given as follows:

$$d = (6228.832-6228.750)/6228.832\times 10^5 = 1.32\ [I-\text{Unit}]$$

The error d calculated as above per disc 7 by the error computing section 16 is fed to the corrected shape distribution calculating section 26, and this error d is added as a correction value to each shape value per disc 7 forming a shape distribution. Then, each shape value is corrected by the amount of the error due to the deflection of the shape detecting roller 3. Thereafter, the corrected shape is indicated by the shape display panel 6.

According to the deflection detecting device for the rolled strip shape detecting roller in the first embodiment of the present invention, it is possible to obtain a shape of the rolled strip 4 with less error, namely, approximate to the actual shape.

Although the deflection $V_2$ of the shape detecting roller 3 due to the tare thereof is calculated by the deflection computing section 14 according to the information from the mill master panel 32 in the above embodiment, the deflection $V_2$ may be previously measured in a shop upon installation of the roller or delivery from the factory, and may be previously stored as the information relating to the roller 3 in the mill master panel 32 as the storage means. In this case, the tare deflection computing section 14 is omitted, and the deflection of the roller 3 due to the tare is outputted from the mill master panel 32 directly to the total deflection computing section 15.

Figure 3:
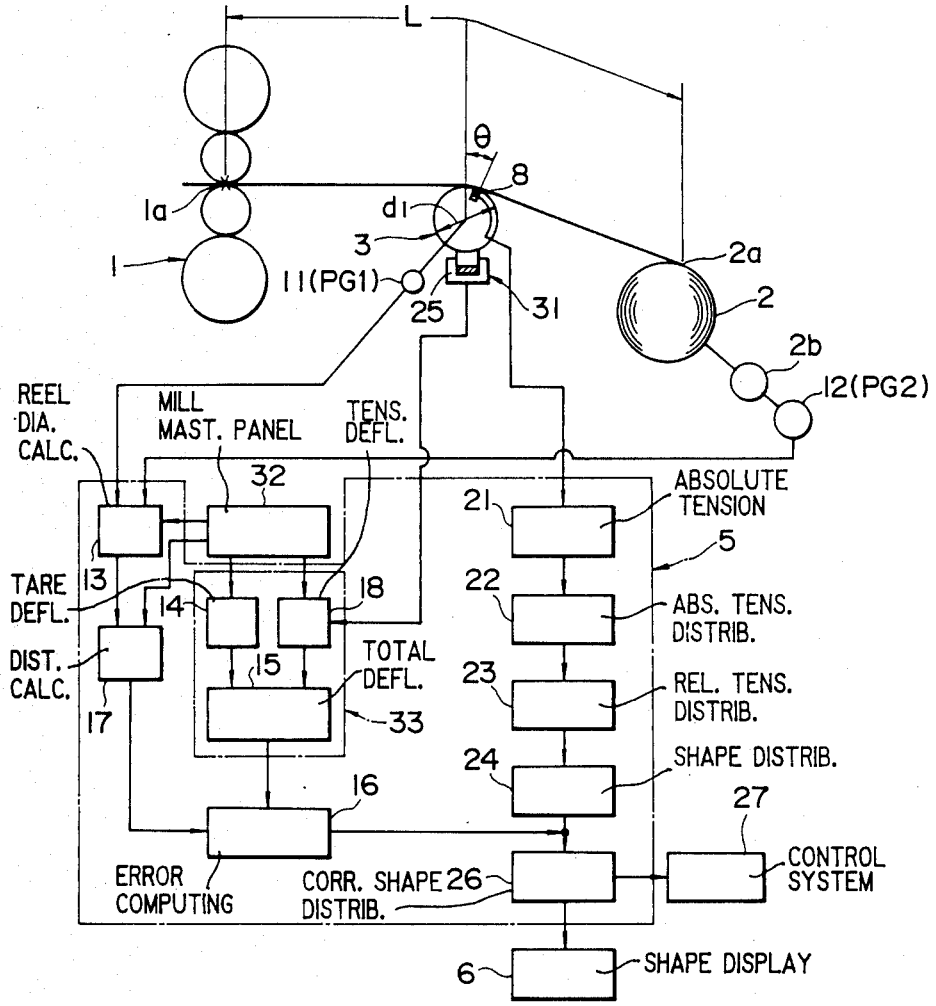
FIG. 3 is a block diagram of a second preferred embodiment of the present invention.

Referring next to FIG. 3 which shows a second preferred embodiment of the present invention, the overall construction of this embodiment except the tension calculating system 31 is substantially the same as that of the first preferred embodiment. In the second embodiment, the total tension data to be fed to the tension deflection computing section 18 is directly detected by a load cell 25 as the tension detecting means provided at the shape detecting roller 3 rather than being fed from the absolute tension distribution calculating step 22.

The load cell 25 is so located as to measure loads in the vertical and transverse directions of the shape detecting roller 3, for example, thereby measuring the total tension to the shape detecting roller 3.

With this arrangement, the second preferred embodiment can provide substantially the same results as the first preferred embodiment.

Figure 4:
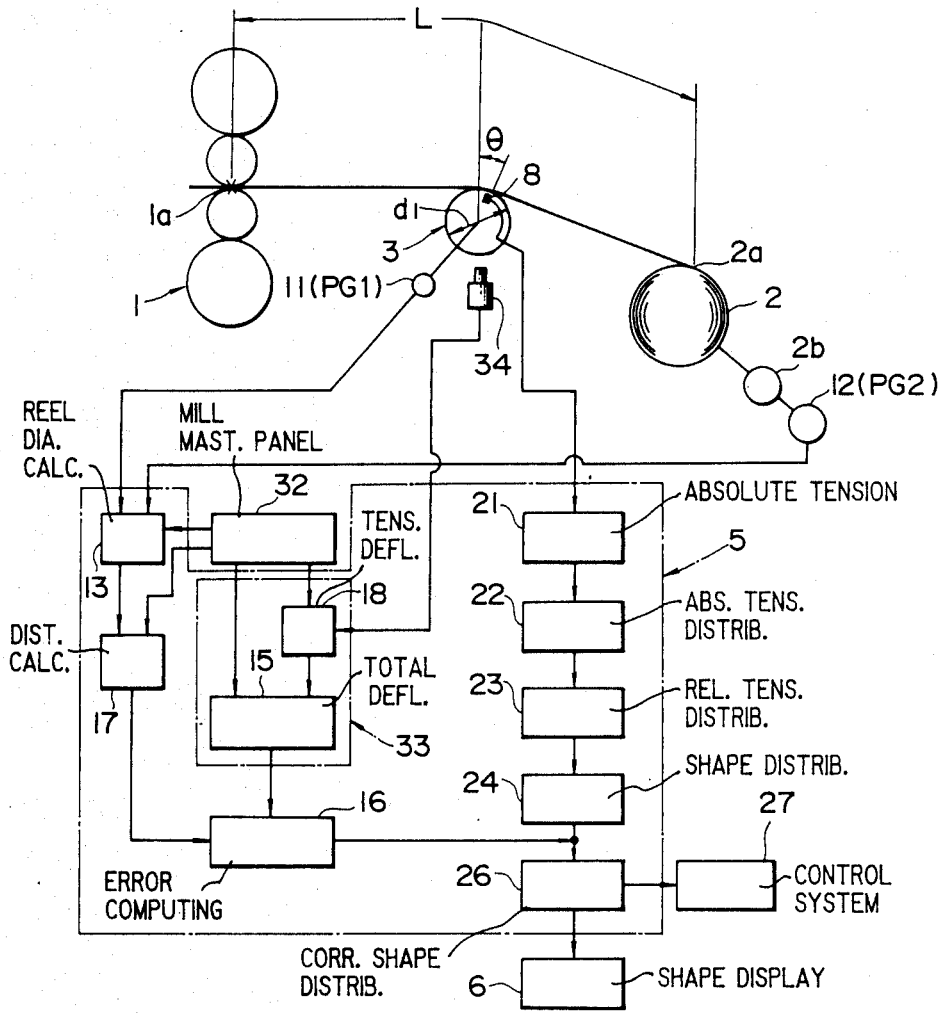
FIG. 4 is a block diagram of a third preferred embodiment of the present invention.
Figure 5:
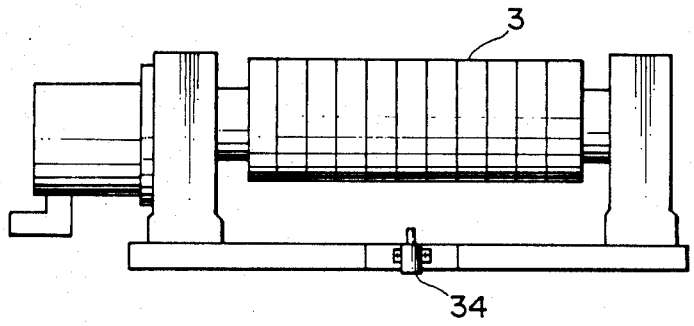
FIG. 5 is an elevational view of the shape detecting roller with an associated position sensor shown in FIG. 4.
Figure 6:
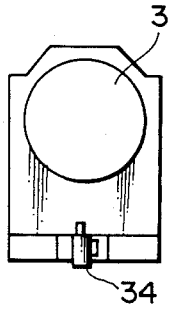
FIG. 6 is a side view of the shape detecting roller shown in FIG. 4.
Figure 7:
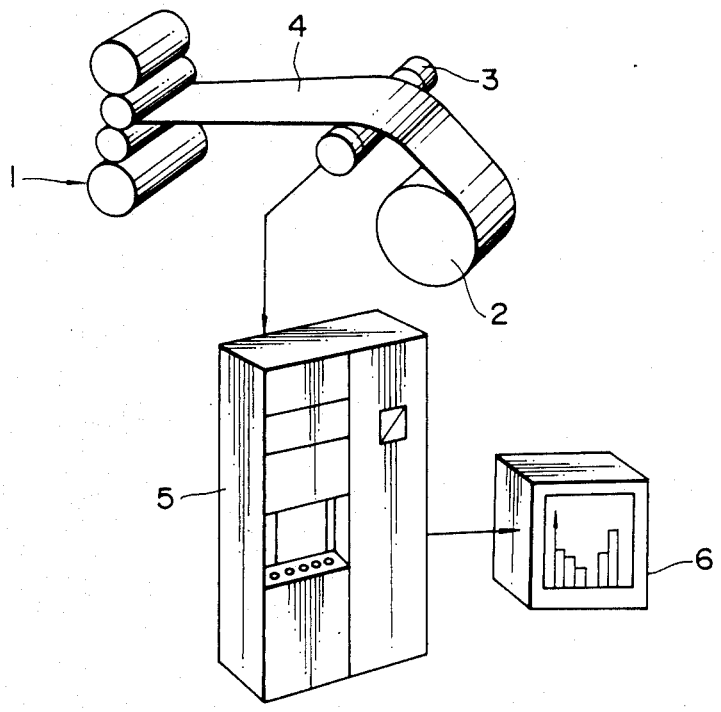
FIGURE 7 PRIOR ART
FIG. 7 is a schematic illustration of the rolled strip shape detecting device in the prior art.
Figure 8:
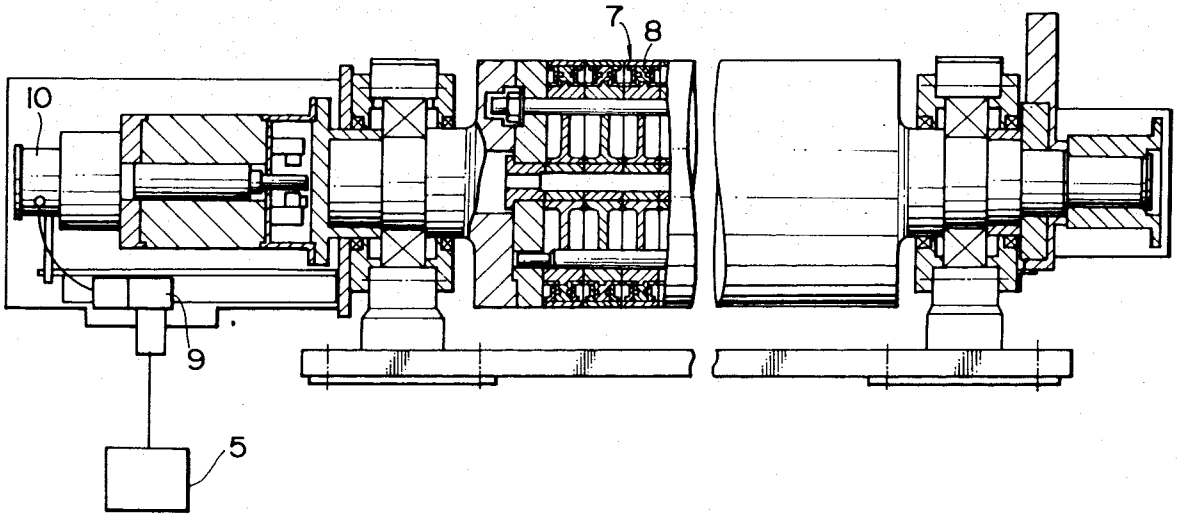
FIGURE 8 PRIOR ART
FIG. 8 is an elevational view of the shape detecting roller shown in FIG. 7.
Figure 9:
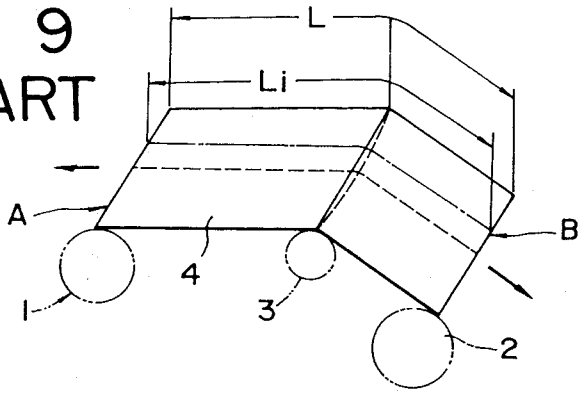
FIGURE 9 PRIOR ART
FIG. 9 is a diagrammatic perspective view of the deflected condition of the shape detecting roller.

Referring next to FIGS. 4 to 6 which show a third preferred embodiment of the present invention, the overall construction of this embodiment is substantially the same as that of the first and the second embodiment except that the tension calculating system 31 or the load cell 25 is substituted by a non-contact type position sensor 34 such as an ultrasonic probe as roller deformation detecting means. As shown in FIGS. 5 and 6, the position sensor 34 is located below a central portion of the shape detecting roller 3.

The position sensor 34 is designed to directly detect deformation of the roller 3 due to the tension applied to the roller 3 at the central portion of the roller 3 (which deformation corresponds to a deflection due to the tension applied to the roller 3) as a difference in deformation between under tension and under no tension. The deformation detected by the position sensor 34 is fed to the tension deflection computing section 18 in the computing means 33. Then, the tension deflection computing section 18 calculates the deflection of the roller 3 due to the tension of the rolled strip at the portions other than the central portion of the roller 3 according to the aforementioned expressions (1) and (2). The result of calculation is inputted to the total deflection computing section 15.

In the third embodiment, the deflection $V_2$ of the shape detecting roller 3 due to the tare thereof is previously measured in a shop upon installation of the roller or delivery from the factory, and is previously stored as the information relating to the roller 3 in the mill master panel 32 as the storage means. Accordingly, the tare deflection computing section 14 as mentioned in the first and the second embodiment is omitted, and the deflection of the roller 3 due to the tare is outputted from the mill master panel 32 directly to the total deflection computing section 15.

With this arrangement, the third embodiment can provide substantially the same effect as of the first and the second embodiment.

Although the deformation only at the central portion of the roller 3 is detected by the position sensor 34, and the deformation at the other portions is computed by the deformation computing section 18 in the third embodiment, the position sensor 34 may be designed to scan along the roller barrel so as to actually measure a distribution of the deformation due to the tension across the width of the rolled strip 4. In this case, the tension deflection computing section 18 may be also omitted.

Alternatively, another similar position sensor may be movably located according to the transverse end position of the rolled strip 4 on the roller 3 in addition to the position sensor 34. With this arrangement, the deformation of the roller 3 at the position corresponding to the transverse end of the rolled strip 4 is always detected by the additional position sensor, and the deflection of the roller 3 from the transverse end of the rolled strip 4 to the supported portion of the roller 3 is obtained according to the deformation detected above is accordance with a linear expression approximation, while the deformation of the roller 3 contacting the rolled strip 4 is obtained in accordance with a quadratic expression approximation.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A device for detecting a rolled strip shape with high accuracy, comprising:

a shape detecting roller provided between a rolling mill for rolling a metal strip and a winder for winding under tension a rolled strip rolled by said rolling mill, said roller being adapted to contact said rolled strip and having means for detecting a shape of said rolled strip;

means for producing a calculated shape distribution signal based on the detected shape of the rolled strip;

tension detecting means for detecting tension applied to said roller;

storage means for storing information relating to said rolled strip and said roller; and arithmetic means for computing deflection of said roller according to the tension detected by said tension detecting means and the information relating to said rolled strip and said roller stored by said storage means and for correcting the shape distribution signal for said rolled strip in accordance with the computed deflection of said roller.

2. The device as defined in claim 1, wherein said tension detecting means comprises a sensor provided in said roller, absolute tension calculating means for calculating an absolute tension of said rolled strip per element of said roller according to a radial load detected by said sensor, absolute tension distribution calculating means for calculating an absolute tension distribution in the axial direction of said roller from the absolute tension calculated by said absolute tension calculating means, and actual tension calculating means for calculating an actual tension of said rolled strip according to the absolute tension distribution calculated by said absolute tension distribution calculating means.

3. The device as defined in claim 1, wherein said storage means stores a span dimension of said roller, a width dimension of said rolled strip, distances between centers of bearings supporting both ends of said roller and transverse ends of said rolled strip, a geometrical moment of inertia of said roller, an elastic constant of said roller, a weight value of said roller per unit length between the centers of the bearings, a diameter dimension of said roller, and a contact angle of said rolled strip to said roller.

4. The device as defined in claim 1, wherein said arithmetic means comprises tension deflection computing means for computing the deflection of said roller due to the tension of said rolled strip according to the tension detected by said tension detecting means and the information stored by said storage means, tare deflection computing means for computing the deflection of said roller due to tare of said roller according to the information stored by said storage means, total deflection calculating means for calculating a total deflection from the deflection computed by said tension deflection computing means and the deflection computed by said tare deflection computing means, and error computing means for calculating an error in the shape according to the total deflection calculated by said total deflection calculating means and the information stored by said storage means.

5. The device as defined in claim 1, wherein said tension detecting means comprises a load cell provided at said shape detecting roller for measuring loads in the vertical and transverse directions of said roller.

6. A device for detecting a rolled strip shape with high accuracy, comprising:

a shape detecting roller provided between a rolling mill for rolling a metal strip and a winder for winding under tension a rolled strip rolled by said rolling mill, said roller being adapted to contact said rolled strip so as to detect a shape of said rolled strip;

roller deformation detecting means for detecting deformation of said roller due to tension applied to said roller;

storage means for storing information relating to said rolled strip and said roller; and arithmetic means for computing deflection of said roller according to the deformation detected by said roller deformation detecting means and the information relating to said rolled strip and said roller stored by said storage means and for correcting the shape of said rolled strip detected by said roller according to the deflection of said roller as computed above.

7. The device as defined in claim 6, wherein said roller deformation detecting means comprises a non-contact type position sensor.

8. The device as defined in claim 7, wherein said position sensor is located below a transverse central portion of said roller.

9. The device as defined in claim 7, wherein said position sensor comprises means for detecting difference in deformation of said roller between under tension and under no tension.

10. The device as defined in claim 6, wherein the information relating to said roller includes a deflection of said roller due to tare thereof.

11. The device as defined in claim 7, wherein said position sensor comprises means for scanning in the axial direction of said roller.

12. The device as defined in claim 8 further comprising another position sensor movably located along said roller according to the transverse end of said rolled strip.

* * * * *